US011411345B2

(12) United States Patent
Holway

(10) Patent No.: US 11,411,345 B2
(45) Date of Patent: Aug. 9, 2022

(54) MAGNETIC ELECTRICAL OUTLET ASSEMBLY

(71) Applicant: Trenton Holway, Hughson, CA (US)

(72) Inventor: Trenton Holway, Hughson, CA (US)

( * ) Notice: Subject to any disclaimer, the term of this patent is extended or adjusted under 35 U.S.C. 154(b) by 99 days.

(21) Appl. No.: 17/089,439

(22) Filed: Nov. 4, 2020

(65) Prior Publication Data

US 2022/0140528 A1 May 5, 2022

(51) Int. Cl.

| | |
|---|---|
| ***H01R 11/30*** | (2006.01) |
| ***H01R 13/62*** | (2006.01) |
| ***H01R 31/06*** | (2006.01) |
| ***H01R 13/502*** | (2006.01) |
| ***H01R 33/88*** | (2006.01) |
| ***H01R 33/20*** | (2006.01) |

(52) U.S. Cl.

CPC ..... *H01R 13/6205* (2013.01); *H01R 13/5025* (2013.01); *H01R 31/06* (2013.01); *H01R 33/205* (2013.01); *H01R 33/88* (2013.01)

(58) Field of Classification Search

CPC ..... H01R 13/6205; H01R 13/5025; H01R 31/06; H01R 33/205; H01R 33/88

See application file for complete search history.

(56) References Cited

U.S. PATENT DOCUMENTS

| | | | | |
|---|---|---|---|---|
| 3,363,214 A | | 1/1968 | Wright | |
| 3,521,216 A | * | 7/1970 | Tolegian | H01R 13/6205 439/675 |
| 3,786,391 A | * | 1/1974 | Mathauser | H01R 13/6205 439/246 |
| 3,808,577 A | * | 4/1974 | Mathauser | H01R 13/6205 439/246 |
| 3,810,258 A | * | 5/1974 | Mathauser | H01R 13/6205 439/246 |
| 7,726,973 B1 | * | 6/2010 | Perry | H01R 13/6205 439/39 |
| D713,790 S | | 9/2014 | Greig | |
| 9,004,930 B2 | * | 4/2015 | Gualino | H01R 13/6205 439/39 |
| 9,019,698 B2 | * | 4/2015 | Thiers | F16M 13/00 320/108 |
| 9,083,110 B2 | | 7/2015 | McClelland | |
| 9,088,097 B2 | * | 7/2015 | Kim | H01R 24/38 |
| 9,531,118 B2 | | 12/2016 | Byrne | |
| 9,660,378 B2 | * | 5/2017 | Silvers | H01R 13/516 |
| 9,848,071 B2 | * | 12/2017 | Thiers | H01R 31/06 |
| 10,096,938 B2 | * | 10/2018 | McClelland | H01R 13/6205 |
| 10,135,179 B2 | * | 11/2018 | Cooper | A47J 43/07 |
| 10,312,640 B2 | * | 6/2019 | Giampi | H01R 24/38 |
| 10,579,096 B1 | * | 3/2020 | Emgin | H01R 13/6205 |
| 2014/0120746 A1 | * | 5/2014 | Persion | H01R 13/6205 439/39 |
| 2020/0203895 A1 | * | 6/2020 | Veidung | H01R 13/6633 |
| 2020/0295801 A1 | * | 9/2020 | Cyzen | H02J 7/02 |

* cited by examiner

*Primary Examiner* — Thanh Tam T Le

(57) ABSTRACT

A magnetic electrical outlet assembly for supplying electrical power to an electronic device includes an outlet that is wired into electrical communication with an electrical system in a building. A wall plate is magnetically attachable to the outlet and the wall plate receives the electrical power from the electrical system. A socket is magnetically attachable to the wall plate and the socket receives electrical power from the electrical system. A female electrical outlet is integrated into the socket to receive a male electrical plug.

12 Claims, 6 Drawing Sheets

MAGNETIC ELECTRICAL OUTLET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to outlet devices and more particularly pertains to a new outlet device for supplying electrical power to an electronic device.

(2) Description of Related Art Including Information Disclosed Under 37 CFR 1.97 and 1.98

The prior art relates to outlet devices including a magnetic male electrical plug. The prior art discloses a magnetic outlet assembly that includes an outlet and a socket that magnetically engages the outlet. The prior art discloses an electrical outlet assembly that includes a breakaway plug. The prior art discloses a power coupling that includes a pair of magnetic electrical couplers. The prior art discloses a magnetic electrical outlet that includes a plurality of ring shaped contacts.

BRIEF SUMMARY OF THE INVENTION

An embodiment of the disclosure meets the needs presented above by generally comprising an outlet that is wired into electrical communication with an electrical system in a building. A wall plate is magnetically attachable to the outlet and the wall plate receives the electrical power from the electrical system. A socket is magnetically attachable to the wall plate and the socket receives electrical power from the electrical system. A female electrical outlet is integrated into the socket to receive a male electrical plug.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
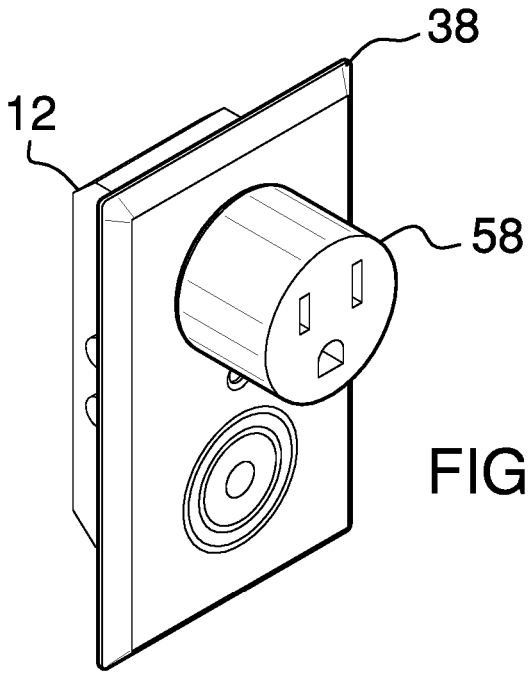
FIG. 1 is a front perspective view of a magnetic electrical outlet assembly according to an embodiment of the disclosure.
Figure 2:
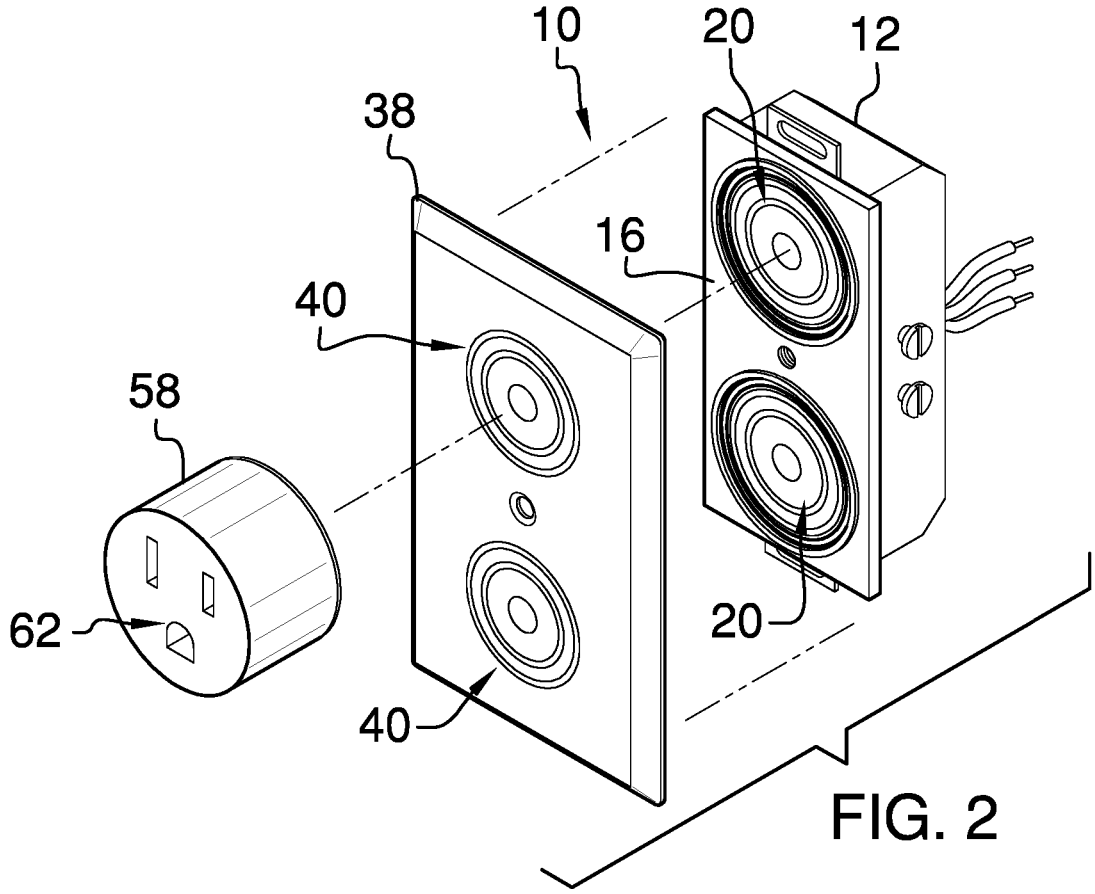
FIG. 2 is an exploded perspective view of an embodiment of the disclosure.
Figure 3:
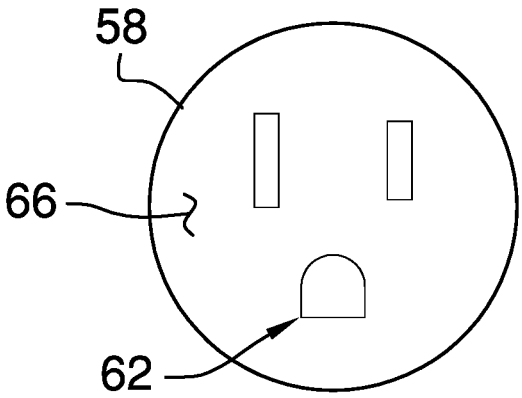
FIG. 3 is a front view of a socket of an embodiment of the disclosure.
Figure 4:
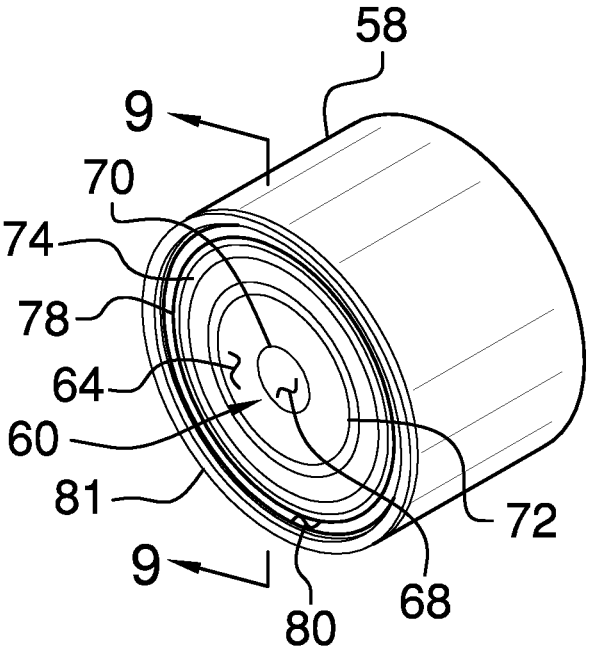
FIG. 4 is a back perspective view of a socket of an embodiment of the disclosure.
Figure 5:
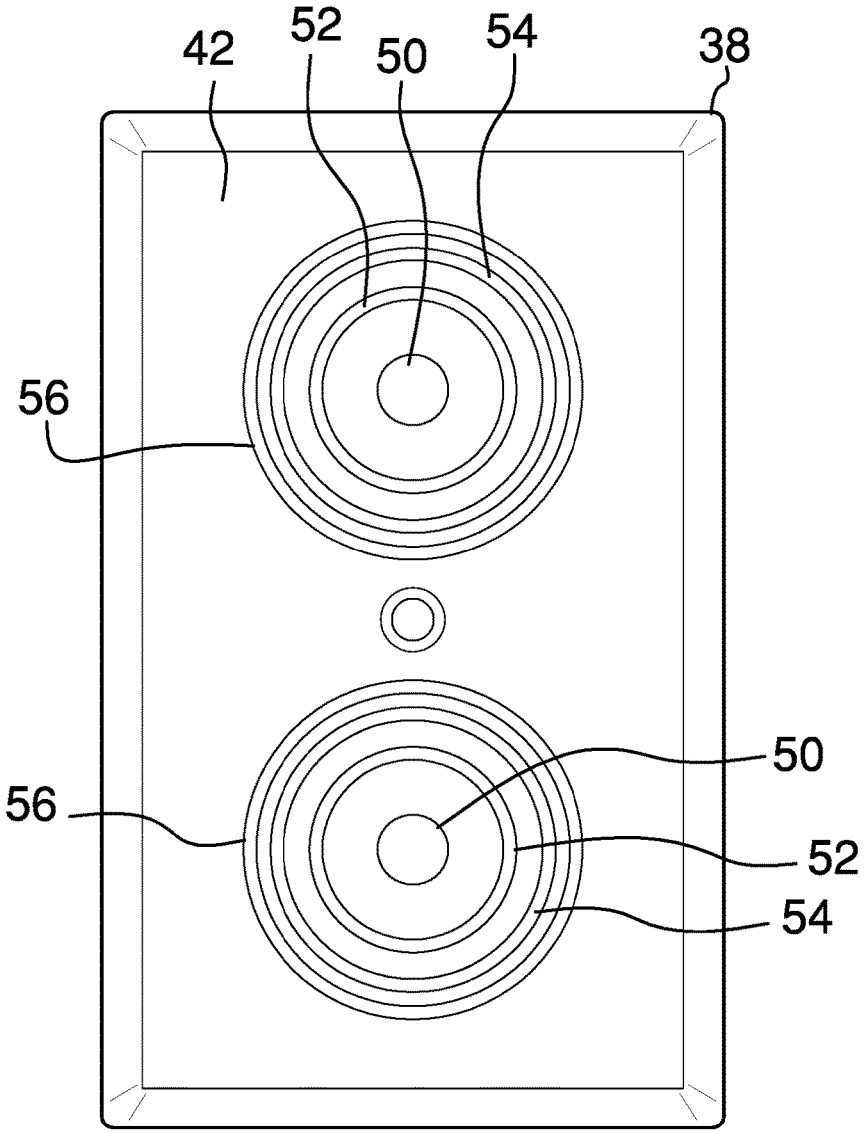
FIG. 5 is a front view of a wall plate of an embodiment of the disclosure.
Figure 6:
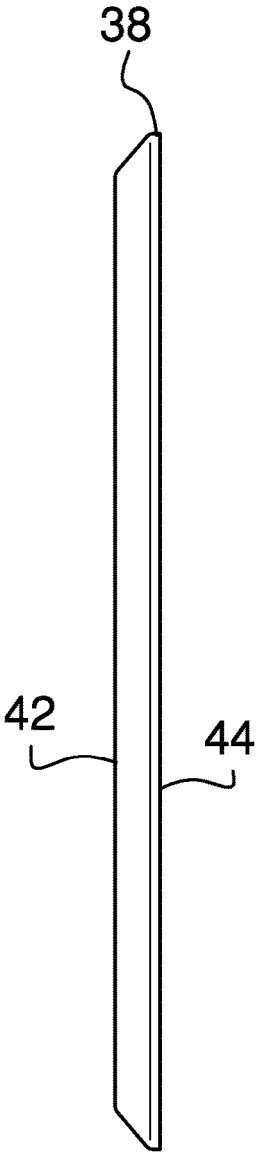
FIG. 6 is a right side view of a wall plate of an embodiment of the disclosure.
Figure 7:
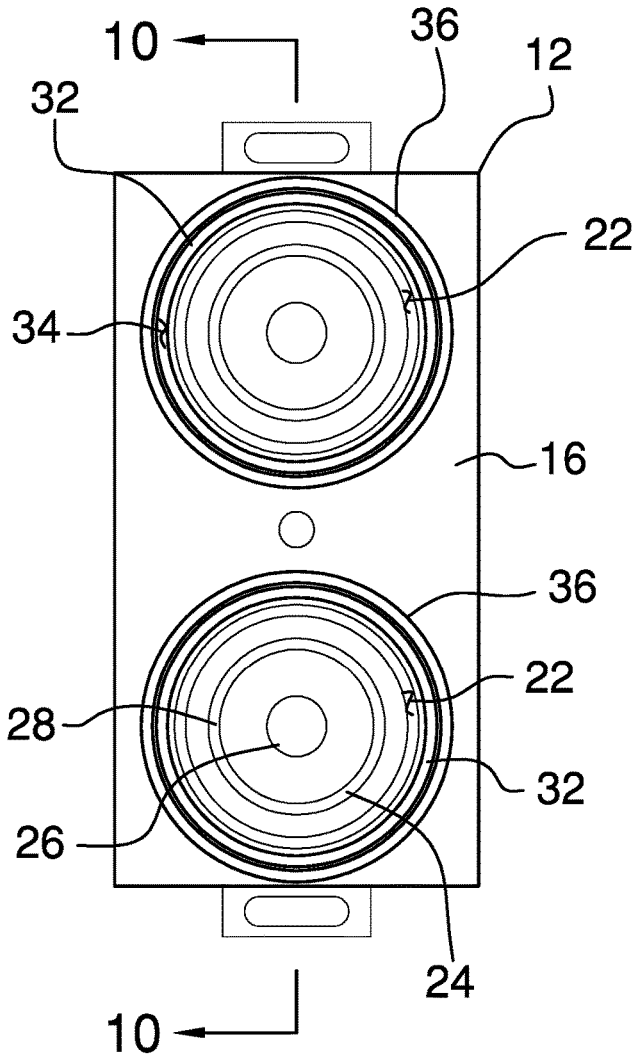
FIG. 7 is a front view of an outlet of an embodiment of the disclosure.
Figure 8:
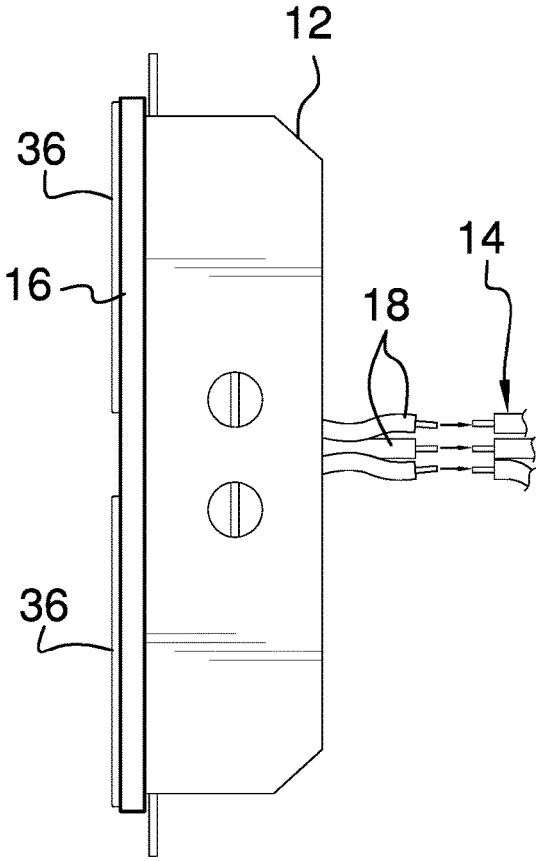
FIG. 8 is a left side view of an outlet of an embodiment of the disclosure.
Figure 9:
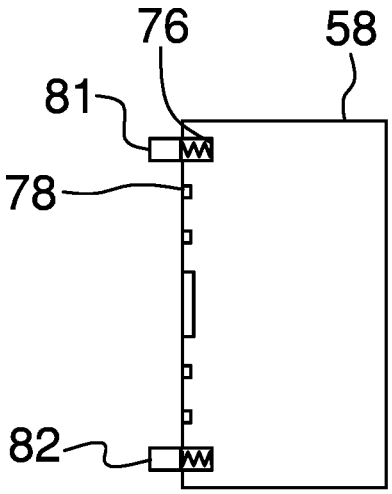
FIG. 9 is a cross sectional view taken along line 9-9 of FIG. 4 of an embodiment of the disclosure.
Figure 10:
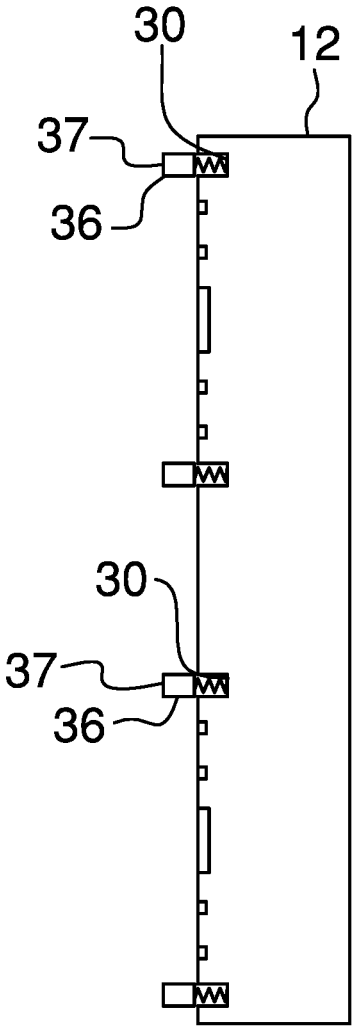
FIG. 10 is a cross sectional view taken along line 10-10 of FIG. 7 of an embodiment of the disclosure.

With reference now to the drawings, and in particular to FIGS. 1 through 10 thereof, a new outlet device embodying the principles and concepts of an embodiment of the disclosure and generally designated by the reference numeral 10 will be described.

As best illustrated in FIGS. 1 through 10, the magnetic electrical outlet assembly 10 generally comprises an outlet 12 that is wired into electrical communication with an electrical system 14 in a building. In this way the outlet 12 receives electrical power from the electrical system 14. The outlet 12 has a front face 16 and the outlet 12 has a plurality of conductors 18 that is each electrically coupled thereto. Each of the conductors 18 is electrically coupled to the electrical system 14. A plurality of sets of first contacts 20 is coupled the outlet 12 and each of the sets of first contacts 20 is in electrical communication with a respective one of the conductors 18. In this way each of the sets of first contacts 20 receives the electrical power from the electrical system 14.

The sets of first contacts 20 are positioned on the front face 16 having an exposed surface 22 of each of the sets of first contacts 20 lying flush with the front face 16. Each of the sets of first contacts 20 includes a center contact 24, a middle contact 26 surrounding the center contact 24 and an outer contact 28 surrounding the middle contact 26. The front face 16 has a pair of slots 30 each extending inwardly therein and each of the slots 30 surrounds the outer contact 28 of a respective one of the sets of first contacts 20. A pair of first magnets 32 is each coupled to the outlet 12 and each of the first magnets 32 is recessed into the front face 16 of the outlet 12 having an exposed surface 34 of each of the first magnets 32 lying flush with the front face 16. Additionally, each of the first magnets 32 surrounds the outer contact 28 of a respective set of first contacts 20.

A pair of first grommets 36 is provided and each of the first grommets 36 is positioned in a respective slot 30. Each of the first grommets 36 is biased outwardly from the respective slot 30 such that a forward surface 37 of each of the first grommets 36 is spaced from the front face 16 of the outlet 12. Additionally, each of the first grommets 36 is urgeable into the respective slot 30 having the forward surface 32 lying flush with the front face 16. Each of the first grommets 36 may be comprised of a resiliently compressible material such as rubber or the like.

A wall plate 38 is provided and the wall plate 38 is attachable to the outlet 12. A plurality of sets of second contacts 40 is coupled to the wall plate 38. Each of the sets of second contacts 40 is placed in electrical communication with a respective one of the first contacts 20 when the wall plate 38 is attached to the outlet 12. In this way each of the sets of second contacts 40 receives the electrical power from the electrical system 14. The wall plate 38 has a forward face 42 and a rear face 44. Each of the sets of second contacts 40 extends through the wall plate 38 having a front surface 46 of each of the sets of second contacts 40 lying flush with the forward face 42. Additionally, a back surface 48 of each of the sets of second contacts 40 lies flush with the rear face 44.

Each of the sets of second contacts 40 includes a centermost contact 50, a medial contact 52 surrounding the centermost contact 50 and an outermost contact 54 surrounding the medial contact 52. Each of the centermost contact 50, the medial contact 52 and the outermost contact 54 electrically engages a respective one of the center contact 24, the middle contact 26 and the outer contact 28 when the wall plate 38 is attached to the outlet 12. A pair of second magnets 56 is each coupled to the wall plate 38 and each of the second magnets 56 magnetically engages the a respective first magnet 32 for retaining the wall plate 38 on the outlet 12. Additionally, each of the second magnets 56 surrounds the outermost contact 54 of a respective set of second contacts 40.

A socket 58 is provided and the socket 58 is attachable to the wall plate 38. A plurality of third contacts 60 is coupled to the socket 58. Each of the third contacts 60 is placed in electrical communication with a respective set of the second contacts 40 when the socket 58 is attached to the wall plate 38. In this way each of the third contacts 60 receives the electrical power from the electrical system 14. A female electrical outlet 62 is integrated into the socket 58 to receive a male electrical plug. The female electrical outlet 62 is in electrical communication with each of the third contacts 60 to receive the electrical power from the electrical system 14.

The socket 58 has a first surface 64 and a second surface 66, and each of the third contacts 60 is recessed into the second surface 66 having an exposed surface 68 of each of the third contacts 60 lying flush with the second surface 66. The plurality of third contacts 60 includes a center socket contact 70, a middle socket contact 72 surrounding the center socket contact 70 and an outer socket contact 74 surrounding the middle socket contact 72. Each of the center socket contact 70, the middle socket contact 72 and the outer socket contact 74 engages a respective one of the centermost contact 50, the medial contact 52 and the outermost contact 54. Additionally, the second surface 66 has a groove 76 extending therein and the groove 76 in the second surface 66 surrounds the outer socket contact 74.

A third magnet 78 is coupled to the socket 58 and the third magnet 78 magnetically engages a respective second magnet 56 for retaining the socket 58 on the wall plate 38. The third magnet 78 is recessed into the second surface 66 of the socket 58 having an exposed surface 80 of the third magnet 78 lying flush with the second surface 66. The third magnet 78 has a ring shape that surrounds the outer socket contact 74. A second grommet 81 is positioned in the groove 76 in the second surface 66 of the socket 58. The second grommet 81 is biased outwardly from the groove 76 such that a rear face 82 of the second grommet 81 is spaced from the second surface 66. The second grommet 81 is urgeable into the groove 76 having the rear face 82 lying flush with the second surface 66.

In use, the outlet 12 is wired into the electrical system 14 of the building in the convention of existing electrical wiring practices. The wall plate 38 is positioned on the outlet 12 and each of the second magnets 56 magnetically engages a respective first magnet 32. Additionally, each of the first grommets 36 is compressed into the respective slot 30 to facilitate each of the sets of second contacts 40 to engage a respective set of first contacts 20. The first grommets 36 reduce the force with which the sets of second contacts 40 engage the first contacts 40. The socket 58 is placed against the wall plate 38 such that the third magnet 78 magnetically engages a respective second magnet 56. The second grommet 80 is compressed into the groove 76 to facilitate the third contacts 60 to engage a respective set of second contacts 40. In this way the socket 58 receives electrical power from the electrical system 14. The magnetic connection between the socket 58 and the wall plate 38 facilitates a breakaway connection when a power cord that is plugged into the socket 58 it tugged. Additionally, the second grommet 80 reduces the force with which the third contacts 60 engage the second contacts 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic electrical outlet assembly for facilitating a quick connection between a wall plate and a female electrical outlet, said assembly comprising:

an outlet being wired into electrical communication with an electrical system in a building wherein said outlet is configured to receive electrical power from the electrical system, said outlet having a plurality of conductors each being electrically coupled thereto, each of said conductors being electrically coupled to the electrical system, said outlet having a plurality of sets of first contacts being coupled thereto, each of said sets of first contacts being in electrical communication with a respective one of said conductors wherein each of said sets of first contacts is configured to receive the electrical power from the electrical system;

a pair of first magnets, each of said first magnets being coupled to said outlet;

a wall plate being attachable to said outlet, said wall plate having a set of second contacts being coupled thereto, each of said second contacts being placed in electrical communication with a respective one of said first contacts when said wall plate is attached to said outlet wherein each of said second contacts is configured to receive the electrical power from the electrical system;

a pair of second magnets, each of said second magnets being coupled to said wall plate, each of said second magnets magnetically engaging a respective one of said first magnets for retaining said wall plate on said outlet;

a socket being attachable to said wall plate, said socket having a plurality of third contacts being coupled thereto, each of said third contacts being placed in electrical communication with a respective set of said second contacts when said socket is attached to said wall plate wherein each of said third contacts is configured to receive the electrical power from the electrical system, said socket having a female electrical outlet being integrated therein wherein said female electrical outlet is configured to receive a male electrical plug, said female electrical outlet being in electrical communication with each of said third contacts wherein said female electrical outlet is configured to receive the electrical power from the electrical system; and a third magnet being coupled to said socket, said third magnet magnetically engaging a respective second magnet for retaining said socket on said wall plate.

2. The assembly according to claim 1, wherein said outlet has a front face, each of said sets of first contacts being positioned on said front face having an exposed surface of each of said sets of first contacts lying flush with said front face, each of said set of first contacts including a center contact, a middle contact surrounding said center contact and an outer contact surrounding said middle contact.

3. The assembly according to claim 2, wherein each of said first magnets is recessed into said front face of said outlet having an exposed surface of said first magnets lying flush with said front face, each of said first magnets surrounding said outer contact of a respective set of first contacts.

4. The assembly according to claim 2, wherein said front face has a pair of slots each extending inwardly therein, each of said slots surrounding said outer contact of a respective set of first contacts.

5. The assembly according to claim 4, further comprising a pair of first grommets, each of said first grommets being positioned in a respective one of said slots, each of said first grommets being biased outwardly from said respective slot such that a forward surface of said first grommets is spaced from said front face of said outlet, each of said first grommets being urgeable into said respective slot having said forward surface of said first grommets lying flush with said front face.

6. The assembly according to claim 2, wherein said wall plate has a forward face and a rear face, each of said sets of second contacts extending through said wall plate having a front surface of each of said sets of second contacts lying flush with said forward face and having a back surface of each of said sets of second contacts lying flush with said rear face.

7. The assembly according to claim 6, wherein each of said sets of second contacts includes a centermost contact, a medial contact surrounding said centermost contact and an outermost contact surrounding said medial contact, each of said centermost contact, said medial contact and said outermost contact electrically engaging a respective one of said center contact, said middle contact and said outer contact when said wall plate is attached to said outlet.

8. The assembly according to claim 1, wherein said socket has a first surface and a second surface, each of said third contacts being recessed into said second surface having an exposed surface of each of said third contacts lying flush with said second surface, said plurality of third contacts including a center socket contact, a middle socket contact surrounding said central socket contact and an outer socket contact surrounding said middle socket contact.

9. The assembly according to claim 8, wherein said third magnet is recessed into said second surface of said socket having an exposed surface of said third magnet lying flush with said second surface, said third magnet surrounding said outer socket contact.

10. The assembly according to claim 8, wherein said second surface has a groove extending therein, said groove in said second surface surrounding said outer socket contact.

11. The assembly according to claim 10, further comprising a second grommet being positioned in said groove in said second surface of said socket, said second grommet being biased outwardly from said groove such that a rear face of said second grommet is spaced from said second surface, said second grommet being urgeable into said groove having said rear face lying flush with said second surface.

12. A magnetic electrical outlet assembly for facilitating a quick connection between a wall plate and a female electrical outlet, said assembly comprising:

an outlet being wired into electrical communication with an electrical system in a building wherein said outlet is configured to receive electrical power from the electrical system, said outlet having a front face, said outlet having a plurality of conductors each being electrically coupled thereto, each of said conductors being electrically coupled to the electrical system, said outlet having a plurality of sets of first contacts being coupled thereto, each of said sets of first contacts being in electrical communication with a respective one of said conductors wherein each of said sets of first contacts is configured to receive the electrical power from the electrical system, each of said sets of first contacts being positioned on said front face having an exposed surface of each of said sets of first contacts lying flush with said front face, each of said set of first contacts including a center contact, a middle contact surrounding said center contact and an outer contact surrounding said middle contact, said front face having a pair of slots extending inwardly therein, each of said slots surrounding said outer contact of a respective set of first contacts;

a pair of first magnets, each of said first magnets being coupled to said outlet, each of said first magnets being recessed into said front face of said outlet having an exposed surface of each of said first magnets lying flush with said front face, each of said first magnets surrounding said outer contact;

a pair of first grommets, each of said first grommets being positioned in a respective one of said slots, each of said first grommet being biased outwardly from said respective slot such that a forward surface of each of said first grommets is spaced from said front face of said outlet, each of said first grommets being urgeable into said respective slot having said forward surface lying flush with said front face;

a wall plate being attachable to said outlet, said wall plate having a plurality of sets of second contacts being coupled thereto, each of said sets of second contacts being placed in electrical communication with a respective one of said first contacts when said wall plate is attached to said outlet wherein each of said sets of second contacts is configured to receive the electrical power from the electrical system, said wall plate having a forward face and a rear face, each of said sets of second contacts extending through said wall plate having a front surface of each of said sets of second contacts lying flush with said forward face and having a back surface of each of said sets of second contacts lying flush with said rear face, each of said sets of second contacts including a centermost contact, a medial contact surrounding said centermost contact and an outermost contact surrounding said medial contact, each of said centermost contact, said medial contact and said outermost contact electrically engaging a respective one of said center contact, said middle contact and said outer contact when said wall plate is attached to said outlet;

a pair of second magnets, each of said second magnets being coupled to said wall plate, each of said second magnets magnetically engaging a respective one of said first magnets for retaining said wall plate on said outlet, each of said second magnets surrounding said outermost contact of a respective one of said sets of second contacts;

a socket being attachable to said wall plate, said socket having a plurality of third contacts being coupled thereto, each of said third contacts being placed in electrical communication with a respective set of said second contacts when said socket is attached to said wall plate wherein each of said third contacts is configured to receive the electrical power from the electrical system, said socket having a female electrical outlet being integrated therein wherein said female electrical outlet is configured to receive a male electrical plug, said female electrical outlet being in electrical communication with each of said third contacts wherein said female electrical outlet is configured to receive the electrical power from the electrical system, said socket having a first surface and a second surface, each of said third contacts being recessed into said second surface having an exposed surface of each of said third contacts lying flush with said second surface, said plurality of third contacts including a center socket contact, a middle socket contact surrounding said central socket contact and an outer socket contact surrounding said middle socket contact, each of said center socket contact, said middle socket contact and said outer socket contact engaging a respective one of said centermost contact, said medial contact and said outermost contact, said second surface having a groove extending therein, said groove in said second surface surrounding said outer socket contact;

a third magnet being coupled to said socket, said third magnet magnetically engaging a respective second magnet for retaining said socket on said wall plate, said third magnet being recessed into said second surface of said socket having an exposed surface of said third magnet lying flush with said second surface, said third magnet surrounding said outer socket contact; and a second grommet being positioned in said groove in said second surface of said socket, said second grommet being biased outwardly from said groove such that a rear face of said second grommet is spaced from said second surface, said second grommet being urgeable into said groove having said rear face lying flush with said second surface.

* * * * *